US007141122B2

(12) United States Patent
McKenzie

(10) Patent No.: US 7,141,122 B2
(45) Date of Patent: Nov. 28, 2006

(54) CYLINDRICALLY CONFIGURED CLEANING CLOTH

(75) Inventor: Rebecca Anne McKenzie, Glenwood Springs, CO (US)

(73) Assignee: Rebecca McKenzie, Glenwood Springs, CO (US)

( * ) Notice: Subject to any disclaimer, the term of this patent is extended or adjusted under 35 U.S.C. 154(b) by 0 days.

(21) Appl. No.: 11/202,869

(22) Filed: Aug. 12, 2005

(65) Prior Publication Data

US 2005/0268941 A1 Dec. 8, 2005

Related U.S. Application Data

(63) Continuation of application No. 10/372,049, filed on Feb. 21, 2003, now abandoned.

(51) Int. Cl.
*B08B 1/00* (2006.01)

(52) U.S. Cl. ..... 134/6; 15/227

(58) Field of Classification Search ..... 15/227; 2/242; 134/6

See application file for complete search history.

(56) References Cited

U.S. PATENT DOCUMENTS 2,125,451 A * 8/1938 Kolliner ..... 36/2 R
2,942,442 A * 6/1960 Egbert ..... 66/174
3,268,913 A * 8/1966 Gettinger ..... 2/171
4,542,597 A * 9/1985 Baptista et al. ..... 36/2 R
4,791,777 A * 12/1988 Sacane ..... 54/80.4
4,893,372 A * 1/1990 Wenzel ..... 15/227
5,010,597 A * 4/1991 Glover ..... 2/242
D366,349 S * 1/1996 Barney ..... D29/120.1
5,592,953 A * 1/1997 Delao ..... 128/882
5,918,341 A * 7/1999 Hale ..... 15/209.1
6,019,854 A * 2/2000 Thomas ..... 134/6
D442,765 S * 5/2001 Newman ..... D2/610
6,237,184 B1 * 5/2001 Lenaghan ..... 15/210.1
2001/0031939 A1 * 10/2001 McTamney ..... 602/61

* cited by examiner

*Primary Examiner*—Radnall Chin
(74) *Attorney, Agent, or Firm*—Rebecca McKenzie

(57) ABSTRACT

An open-ended, cylindrically configured cleaning cloth sleeve having elasticized openings at both ends for the purpose of securing the device, as positioned, on the hand, wrist or forearm of a user. The elasticized openings provide ready accessibility to the hand when dusting or cleaning, or immediate withdrawal to the wrist or forearm for temporary storage when not in use. The elasticized openings allow instant hand, finger or fingertip protrusion and retraction while the device remains on the hand of a user.

1 Claim, 6 Drawing Sheets

CYLINDRICALLY CONFIGURED CLEANING CLOTH

This application is a continuation of U.S. patent application Ser. No. 10/372,049, filed Feb. 21, 2003, now abandoned.

This invention relates to dusting-cleaning cloths, specifically to such dusting-cleaning cloths, that are used in commercial or general household cleaning situations for washing, drying or polishing.

BACKGROUND OF THE INVENTION

Most dusting-cleaning cloths are traditionally manufactured as rectangular cut, one-dimensional cloths, available in a variety of fabrics. A flat cloth is quite adequate for most cleaning, dusting or drying tasks—especially when dealing with large, flat surfaces. And most professional cleaning persons prefer a flat cloth to most alternative choices such as the various sundry of cleaning gloves or mitts currently on the market. A mitt restricts the thumb and therefore prevents full contact with the complete surface of the cleaning fabric matter. A flat, open cleaning cloth is more versatile in experienced hands. However, a loose cleaning cloth is easily misplaced or left behind when working a multi-task job.

In recent times, various forms of gloves, mitts or envelope configurations have appeared in the marketplace. These assorted hand enclosures are usually designed for more limited applications than the traditional rectangular cloth, but are popular items in routine household usage. But like the one-dimensional cloth, they are easily misplaced. And these products waste both time and motion in the very act of removing and replacing them on the hand when switching tasks. Such hand enclosures also need to be removed when handling or operating other tools for safety reasons.

BACKGROUND OF INVENTION—OBJECTS AND ADVANTAGES

Accordingly, besides the objects and advantages of the open-ended, cylindrically configured, cleaning cloth sleeve described in my above patent, several objects and advantages of the present invention are:

(a) to provide a cylindrically configured cleaning cloth sleeve which encompasses the entire hand. The thumb is not separated which allows a full range of motion to the hand, thus increasing the maneuverability of the device. Elasticized openings at both ends prevent slippage, allowing the device to be utilized in the manner of a "mitt" without the encumbrance of a separated thumb.

(b) to provide a cylindrically configured cleaning cloth sleeve that allows the wearer to free the fingers quickly without removing the device. Thus the fingers are easily freed to perform delicate or precise tasks. This feature contributes to increased flexibility and versatility of use.

(c) to provide a cylindrically configured cleaning cloth sleeve that is conveniently worn on the person of the user throughout multiple cleaning tasks without removing it. Thus providing constant access to the cleaning device.

(d) to provide a cylindrically configured cleaning cloth sleeve that can be quickly retracted from the hand and repositioned on the wrist when not in use, thus eliminating the need to remove the device when not in use.

(e) to provide a cylindrically configured cleaning cloth sleeve that allows the wearer to switch hands or to rotate on the hand in order to utilize all sides as the device becomes soiled. The device may also be used as a separate entity, that can function as a hand-held, hand-sized, portable dusting-cleaning device. When used in this manner, the cloth exhibits a double layer of material that provides extra bulk. The cylindrically configured cleaning cloth sleeve may be turned inside out when soiled, to provide a fresh, clean surface.

(f) to provide a cylindrically configured cleaning cloth sleeve which can be economically manufactured in a variety of fabrics or other materials to meet the various requirements of general of specific cleaning tasks.

Further objects and advantages are to provide an effective cleaning device, that can be used easily and conveniently for most hands-on cleaning jobs without interruption when switching cleaning tasks or using other tools: as the cylindrically configured cleaning cloth sleeve does not need to be removed for those activities. My cylindrically configured cleaning cloth simply slips up onto the wrist or the forearm when not engaged in a cleaning activity. In addition, the elastic at the opening offers extra bulk and material mass at the fingertips that provides protection and firmness allowing the device to function as a crevice device.

The cylindrically configured cleaning cloth sleeves are completely reusable and may be laundered when soiled, which makes them very economical to use. In a disposable mode, the simplicity of my design allows for economical manufacture which makes them very economical to use as well.

SUMMARY

In accordance with the present invention a cylindrically configured cleaning cloth sleeve comprises a cylindrical body, open and elasticized at both ends to control desired positioning of the device as on the hand when in operation or on the wrist or arm when disengaged.

DRAWINGS—FIGURES

In the drawings, closely related figures have the same number but different alphabetic suffixes.

DRAWINGS

Reference Numerals

Figure 1A:
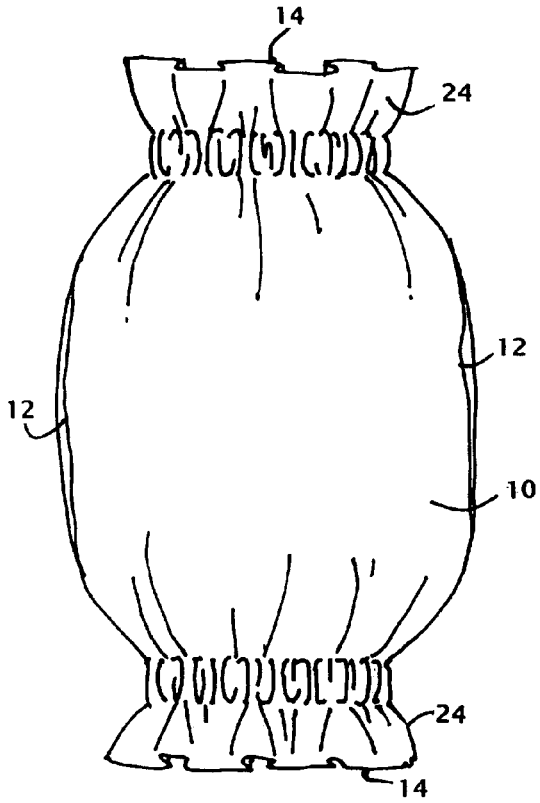
FIGS. 1A to 1B show various aspects and a basic construction pattern of a cylindrically configured, cleaning cloth sleeve. 1A shows the exterior of a finished sleeve. 1B shows the interior construction of the sleeve.

10 sleeve body
12 longitudinal side
14 open end
16 elastic
18 applied casing for elastic
20 fold down casing for elastic
22 opening for threading elastic
24 ruffle
26 ribbed cuffs

DETAILED DESCRIPTION—FIGS. 1A AND 1B—PREFERRED EMBODIMENT

Figure 1B:
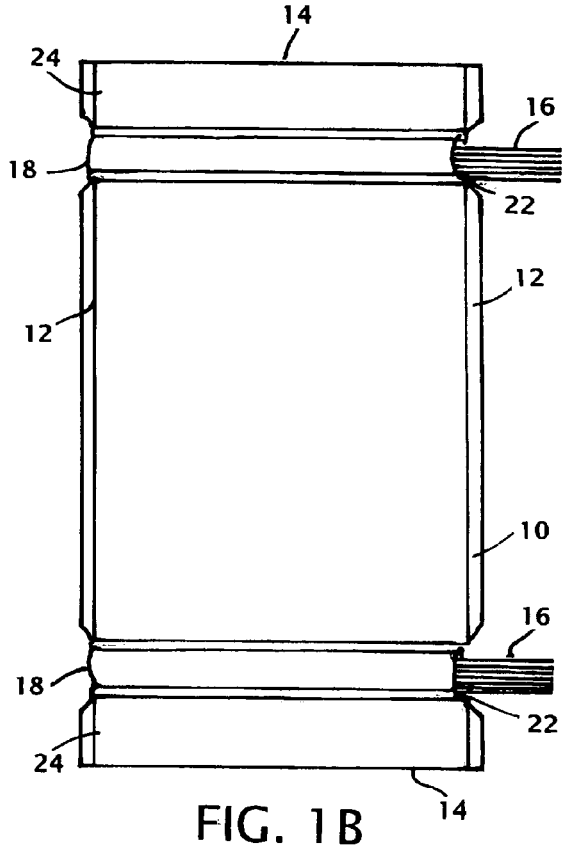

A preferred embodiment of my cylindrically configured cleaning cloth sleeve of the present invention is illustrated in FIG. 1A (outside front view) and FIG. 1B (inside view showing actual construction features). The cylindrically configured, cleaning cloth sleeve body 10 is constructed with two equally sized sheets of material, approximately 8" to 14" long and approximately 6" to 8" wide. The variance is dependent upon the finished manufactured size and the projected usage. The product will be marketed in sizes small, medium and large. The two sections are joined at both longitudinal edges 12, usually by sewing, to form a cylindrical configuration with two open ends 14 that are elasticized by threading a length of elastic 16 into the opening 22 of an applied elastic casing 18. In both open ends 14 of the sleeve, the elastic 16 is sized for the sleeve to easily slip over one's hand and to comfortably fit the wearer's wrist. The applied elastic casing 18 is placed approximately ½" to 1" from the outer edge. This outer edge is preferably left raw or unhemmed. When the elastic 16 is inserted and secured, a gathered extension of base material or ruffle 24 is formed. The ruffle 24 functions as a crevice device when manipulated by the fingertips resting against the applied elastic casing 18.

In the preferred embodiment, the cylindrically configured, cleaning cloth sleeve body 10 is constructed in a micro fiber material which excels for all-purpose use; dusting, cleaning, washing, polishing or drying etc. However, virtually any material typically used for cleaning may be used for the base of my cylindrically configured cleaning cloth sleeve. For example, a fleece material works very well for the application of cleaning solutions; a cotton fabric may be chosen for absorption; a fibrous material for aggressive tasks; a disposable paper material for convenience, etc.

Figure 2:
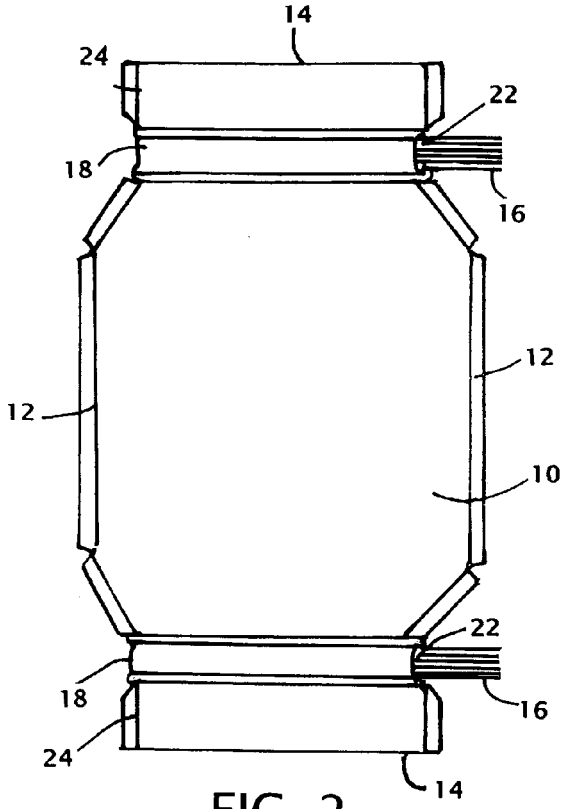
FIG. 2 shows the interior construction of a similar cylindrically configured cleaning cloth sleeve construction with tapered ends.
Figure 3:
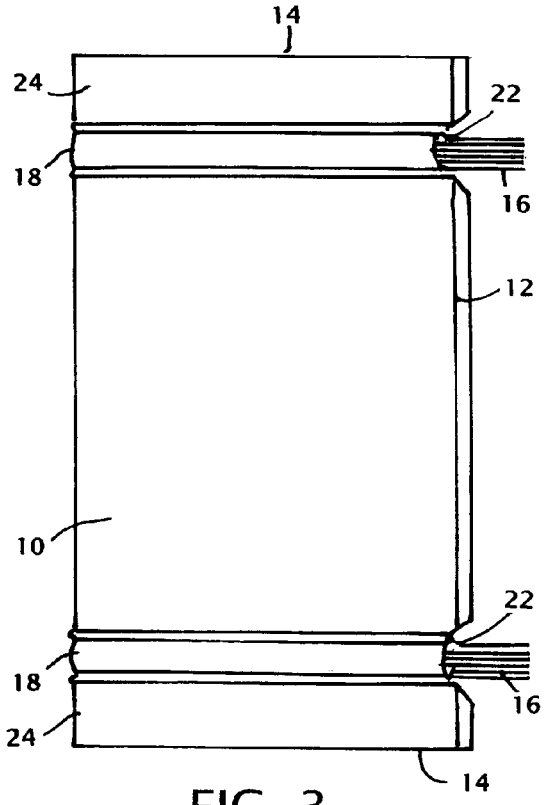
FIG. 3 shows the interior construction of a similar cylindrically configured, cleaning cloth sleeve construction utilizing a single section of material, folded once and stitched on one longitudinal length.
Figure 4:
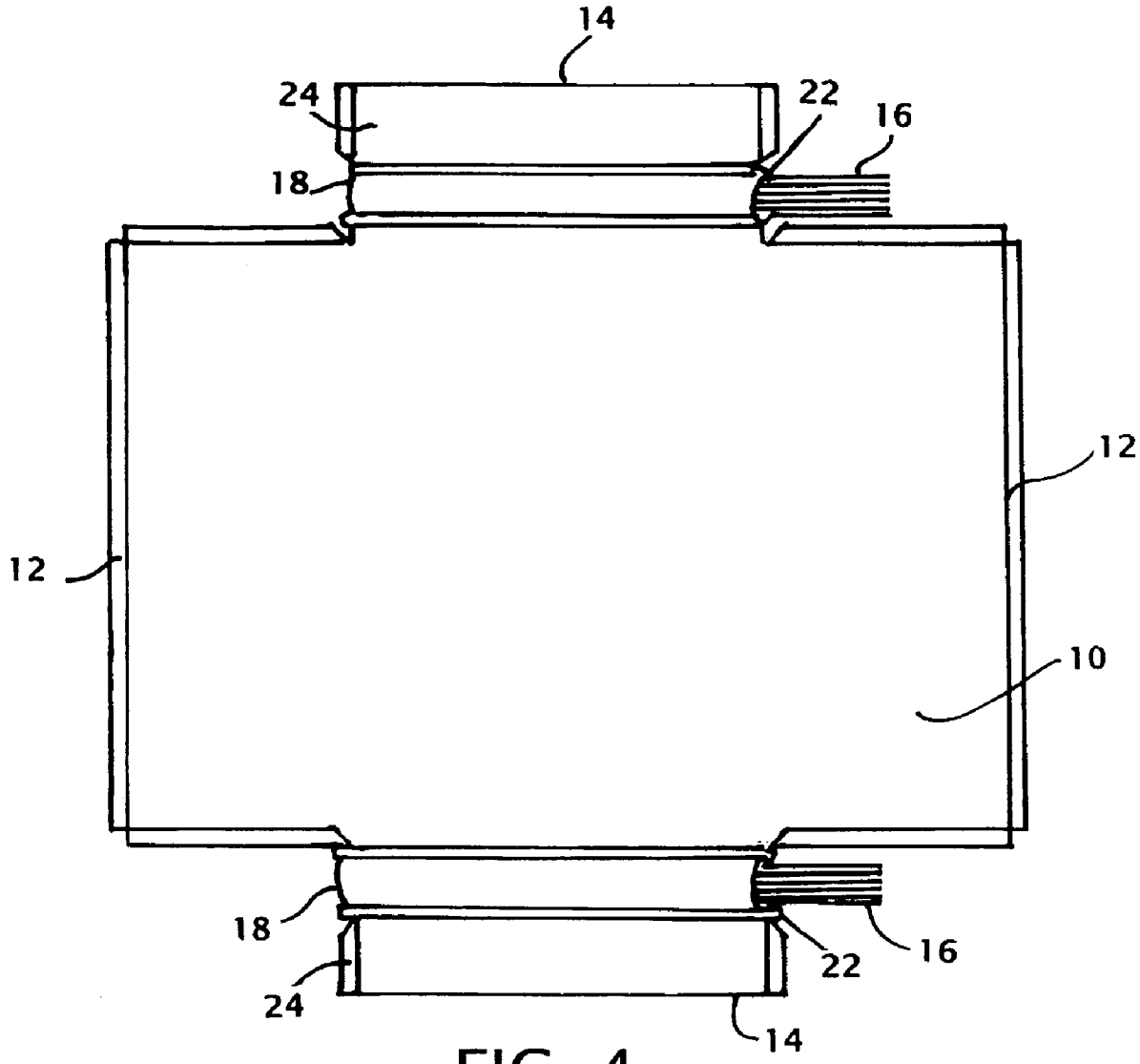
FIG. 4 shows the interior construction of a similar cylindrically configured, cleaning cloth sleeve construction with an over-sized body.

FIGS. 2–4—Additional Embodiments

Additional embodiments are shown in 2, 3, and 4; in each case an inside body 10 and construction are shown before threading with elastic 16. In FIG. 2, the sleeve shows tapered ends that are used to reduce bulkiness at the point of gathering once the elastic 16 is added and secured. This pattern is sometimes useful when the base material is heavy or bulky. In FIG. 3, the cylindrically configured, cleaning cloth sleeve is fashioned by folding a single piece of material and joined or sewn on one longitudinal side 12 only. This pattern is optional for a rigid or static base such as paper or tightly woven materials. FIG. 4 shows an enlarged pattern with all sides joined or stitched before the applied casing 18 for the elastic 16 is added. This sleeve is usually used for drying large areas.

Figure 5:
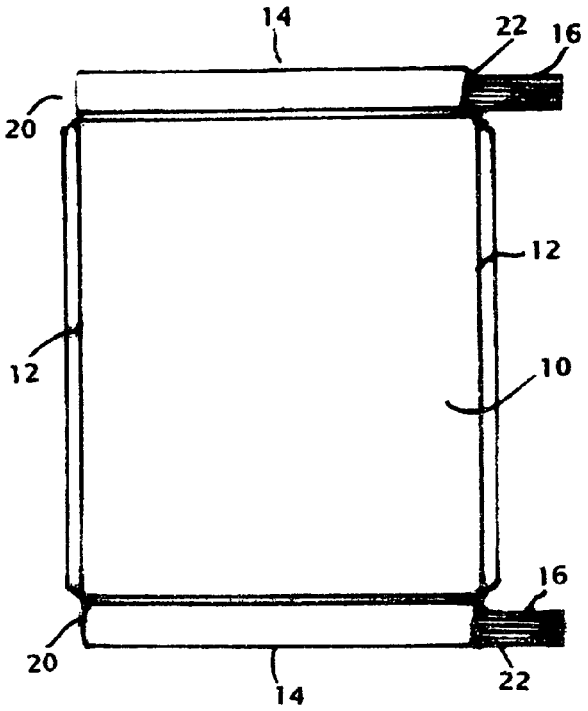
FIG. 5 shows the interior construction of a similar cylindrically configured, cleaning cloth sleeve with a fold down casing.
Figure 6:
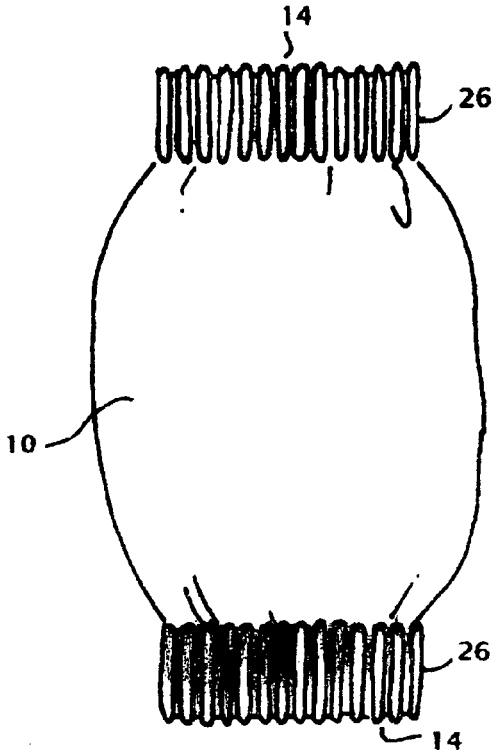
FIG. 6 shows an exterior view of a similar cylindrically configured, cleaning cloth sleeve that is machine knitted with ribbed openings.

FIGS. 5–6—Alternative Embodiments

There are various possibilities with regard to the fabrics or materials used for my cylindrically configured cleaning cloth sleeve. FIG. 5 shows a modified version of my cylindrically configured, cleaning cloth sleeve utilizing a folded over, fold down casing 20 for the elastic 16 in lieu of an applied casing 18. FIG. 6 shows a machine knitted version with ribbed cuffs 26 in lieu of elastic. A machine knitted sleeve may be constructed with micro fiber, wool or cotton yarns.

Operation—FIGS. 7A, 7B, 7C, 7D, 7E, 7F, 7G, 7H

Figure 7A:
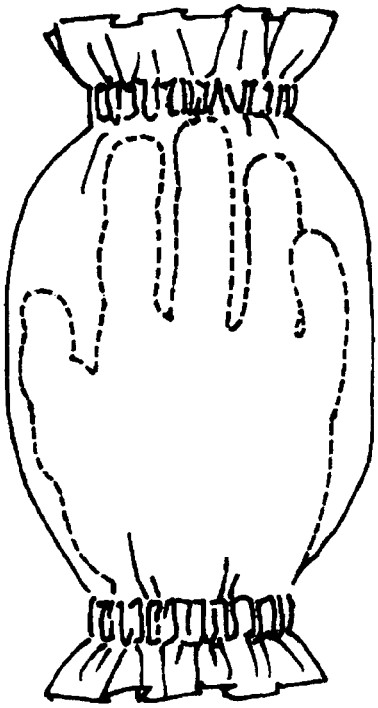
FIGS. 7A to 7H show various operational features and uses.
Figure 7B:
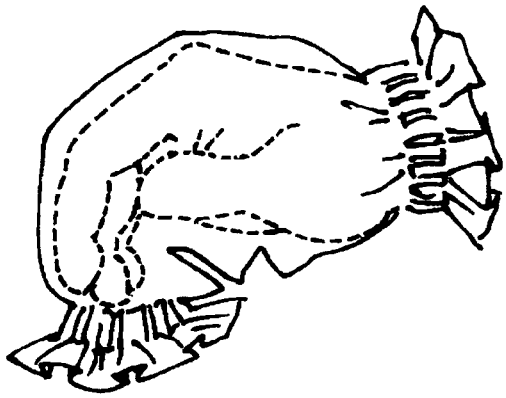

The manner of using my cylindrically configured, cleaning cloth sleeve in the act of cleaning or dusting is similar to that for other products in present use. Namely objects or other surfaces are dusted or cleaned by applying the cloth directly to a surface with the hands. FIG. 7A shows the fit of a hand within a cylindrically configured, cleaning cloth sleeve. The tension created by the fit contributes to concise maneuverability and control of the device when in use. The cylindrically configured cleaning cloth sleeve is fitted to enclose an open hand comfortably, close enough to the edges to create a slight tension against the sides when the thumb and fingers are extended. FIG. 7B shows an application of the sleeve in use.

Figure 7C:
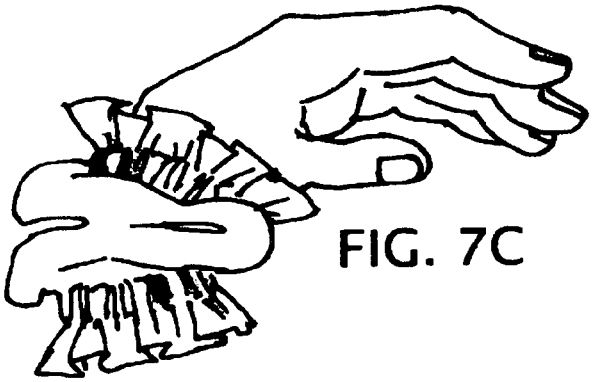

Further, my cylindrically configured, cleaning cloth sleeve, unlike most other products in present use, that need to be removed and put down during and between usage, remains on the wearer's person at all times. The cylindrically configured cleaning cloth sleeve is simply slipped up off of the hand and onto the wrist or forearm of the wearer, where it remains out of the way, in place, for ready recall as needed, as shown in FIG. 7C.

Figure 7D:
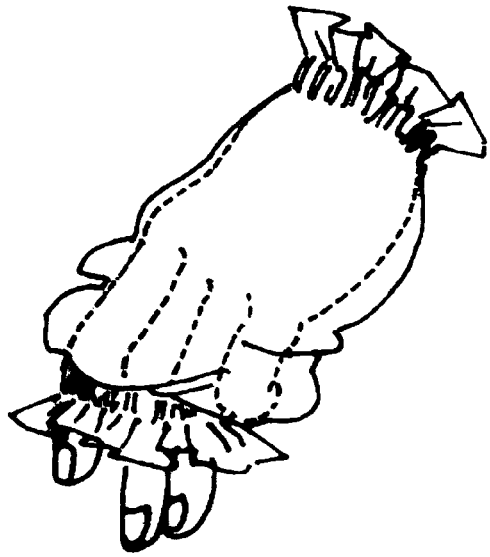

As seen in FIG. 7D, the open ends 14 of the cylindrically configured, cleaning cloth sleeve also allow the fingers to be instantly freed as desired without removing the sleeve. This feature allows for the operation of other tools and complete freedom of the fingers to complete other tasks outside the confines of the sleeve.

Figure 7E:
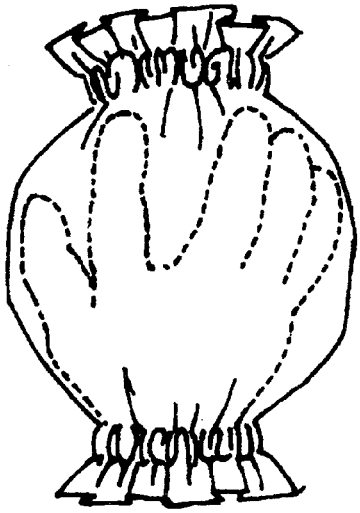

When the hand is encased within the cylindrically configured, cleaning cloth sleeve, the hand moves freely within the sleeve enabling the sleeve to function in a manner similar to using a mitt as seen in FIG. 7E. The fluid movement of the hand, unrestricted within the sleeve, helps alleviate hand fatigue.

My cylindrically configured, cleaning cloth sleeve can be rotated in all directions. It may be reversibly turned inside out, reversibly turned upside down or just side-to-side in order to utilize fresh, unused surfaces as the used surfaces become soiled.

Figure 7F:
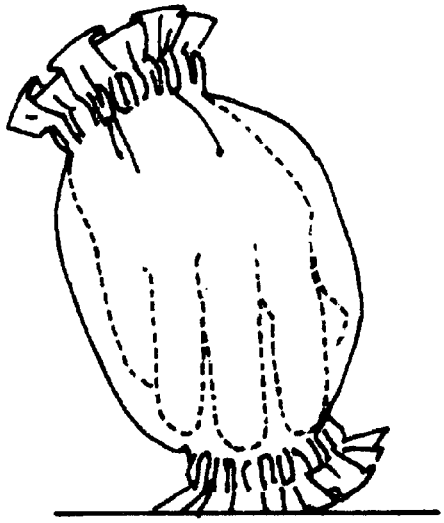

The elastic in an applied casing 18 and extended ruffle 24 beyond the casing offer protection to the fingertips. And the extended ruffle 24 is easily controlled by the fingertips as seen in FIG. 7F, which allows the open end 14 of the sleeve to function in the manner of a crevice cleaning device.

Figure 7G:
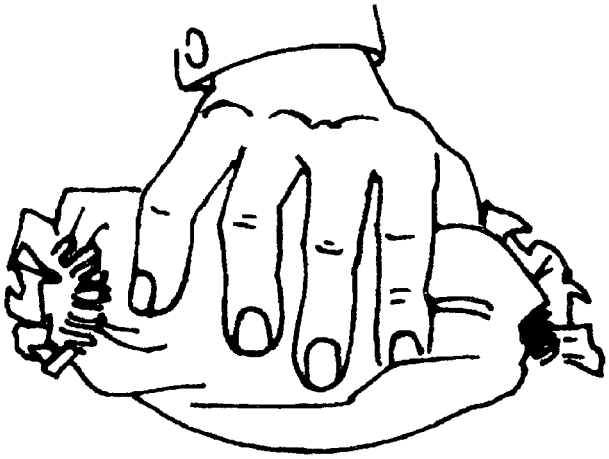
Figure 7H:
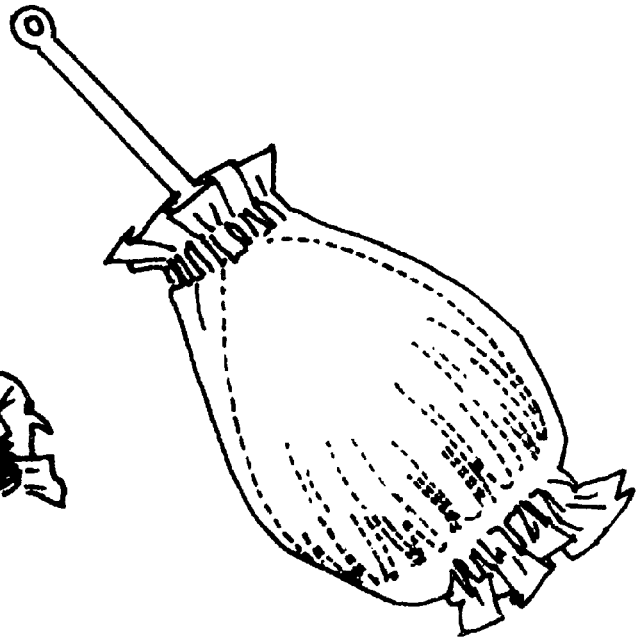

FIG. 7G shows how a cylindrically configured, cleaning cloth sleeve can be utilized as a hand-sized, hand-held dusting or cleaning cloth. FIG. 7H shows a cylindrically configured cleaning cloth sleeve covering a conventional wool or feather duster.

Advantages

From the description above, a number of advantages of my "Cylindrically Configured Cleaning Cloth Sleeve" become evident.

(a) The cylindrical body and open elasticized ends allow my cylindrically configured cleaning tool to actually be worn on the person of the user whether it is in use or not.

(b) The elasticized openings at either end of the cylindrically configured, cleaning cloth sleeve allow it to be used in a similar manner as a mitt.

(c) The slightly fitted width of the cylindrically configured cleaning cloth sleeve provides optimum maneuverability and security of motion.

(d) The elasticized openings at either end of the cylindrically configured, cleaning cloth sleeve, allow the sleeve to be taken out of service quickly by simply sliding the device up and out of the way onto the wrist or the forearm.

(e) The cylindrically configured cleaning cloth sleeve is always available for instant use as needed, thus saving time and motion. And it cannot be misplaced.

(f) The cylindrically configured cleaning cloth sleeve is available in a variety of materials to best accommodate the specific needs of the user.

(g) The open end of the cylindrically configured cleaning cloth sleeve provides for the fingers or the entire hand to be freed instantly.

(h) All surfaces of the cylindrically configured cleaning cloth sleeve are usable. The device may be rotated in any direction, reversibly turned inside out or reversibly turned upside down in order to expose a fresh unsoiled surface.

(i) The elasticized band offers added protection to the users fingertips.

(j) The protruding ruffle beyond the elastic band offers a unique cleaning device that functions as a crevice tool.

Conclusion, Ramifications, and Scope

Accordingly, the reader will see that the cylindrically configured cleaning cloth sleeve of this invention can be used for dusting or cleaning in manner similar to that of a mitt, but it's open end design allows it to be quickly filed away on the wrist or forearm when not in use. This feature saves time and motion, providing instant exit of one's fingers or hand as needed. Furthermore, the cylindrically configured cleaning cloth sleeve has the additional advantages in that

- it's simplicity of design provides for economy in the manufacturing of the product.
- it permits a wide selection of base materials to accommodate a variety of intended cleaning requirements.
- it permits a cleaning device that is reusable and easily laundered with the exception of disposable materials.
- it permits a cleaning tool that is constantly accessible during any cleaning task.

Although the description above contains many specifications, these should not be construed as limiting the scope of the invention but as merely providing illustrations of some of the present preferred embodiments of this invention. For example, the shape, size and body material may vary to accommodate specific uses. The design of my cylindrically configured cleaning cloth sleeve is not limited to household or professional cleaning usage. It can be easily adapted for use by the healthcare industry for bathing and drying the body. In construction, it can be adapted for painters or drywall installation, for example. In fine arts, my cylindrically configured sleeve design may be used for general cleanup, polishing or even the application of paints and various media.

Thus the scope of the invention should be determined by the appended claims and their legal equivalents, rather than by the examples given.

I claim:

1. A method of dusting, wiping, washing, scrubbing, drying, applying, polishing, crevice cleaning, and general cleaning comprising the steps of;

providing an open-ended, multi-function, cylindrically configured, cleaning cloth sleeve having elasticized bands at each end, each said end being of similarly sized diameter, each said elasticized band, defining elasticized openings, the elasticized bands defining a lower elasticized band and an upper elasticized band;

inserting a user's hand into the cleaning cloth sleeve, the cleaning cloth sleeve forming a hand enclosure such that slight tension is created against sides of the cylindrically configured cleaning cloth sleeve when a user's thumb and fingers are extended, providing optimum control and maneuverability;

whereby the cylindrically configured cleaning cloth sleeve provides for immediate access and egress of the user's hand;

inserting a user's hand into the cylindrically configured cleaning cloth sleeve wherein the lower elasticized band, of the elasticized bands, is controlled by a user's fingertips;

inserting a tool into the cylindrically configured cleaning cloth sleeve, forming an enclosure with the cleaning cloth sleeve covering the tool;

whereby the user can manipulate the tool with the sleeve over the tool in order to dust, wipe, wash, scrub, dry, or polish a surface and general cleaning;

manipulating the cylindrically configured cleaning cloth sleeve exteriorly with the user's hand;

whereby the cylindrically configured cleaning cloth sleeve provides for utilizing the cleaning cloth sleeve as a hand held cleaning cloth;

rotating the cylindrically configured cleaning cloth sleeve on the user's hand to expose a fresh, clean surface in order to utilize all sides of the sleeve as the sleeve becomes soiled, wherein the cleaning cloth sleeve may also be reversibly turned inside out, and may also be reversibly turned upside down, when soiled, to expose a fresh clean surface, and repositioning the lower elasticized opening, of the elasticized openings, of the cylindrically configured cleaning cloth sleeve from at or beyond the user's fingertips and positioning the lower elasticized opening onto the fingers or hand of the user, providing for instant finger protrusion, in order to free the fingers to perform delicate or precise tasks and retracting and sliding the cleaning cloth sleeve from the user's hand and repositioning the cleaning cloth sleeve onto a wrist or forearm of the user when not in service and between usages, wherein the cleaning cloth sleeve remains in place on the wrist or forearm of the user for ready recall, as needed, in order to dust, wipe, wash, scrub, dry, or polish a surface and general cleaning.

* * * * *